US009909407B2

(12) United States Patent
Brown-Kerr et al.

(10) Patent No.: US 9,909,407 B2
(45) Date of Patent: Mar. 6, 2018

(54) MONITORING AND TRANSMITTING WELLBORE DATA TO SURFACE

(71) Applicant: Halliburton Manufacturing and Services Limited, Leatherhead, Surrey (GB)

(72) Inventors: William Brown-Kerr, Aboyne (GB); Bruce Hermman Forsyth McGarian, Stonehaven (GB)

(73) Assignee: HALLIBURTON MANUFACTURING AND SERVICES LIMITED, Leatherhead, Surrey (GB)

( * ) Notice: Subject to any disclaimer, the term of this patent is extended or adjusted under 35 U.S.C. 154(b) by 100 days.

(21) Appl. No.: 14/771,518

(22) PCT Filed: May 16, 2014

(86) PCT No.: PCT/GB2014/051522
§ 371 (c)(1),
(2) Date: Aug. 31, 2015

(87) PCT Pub. No.: WO2014/184586
PCT Pub. Date: Nov. 20, 2014

(65) Prior Publication Data

US 2016/0108716 A1 Apr. 21, 2016

(30) Foreign Application Priority Data

May 17, 2013 (GB) ..... 1308915.6
Jul. 18, 2013 (GB) ..... 1312866.5

(51) Int. Cl.
*E21B 47/00* (2012.01)
*E21B 47/18* (2012.01)

(52) U.S. Cl.
CPC ..... *E21B 47/0006* (2013.01); *E21B 47/18* (2013.01)

(58) Field of Classification Search
CPC ..... E21B 47/0006; E21B 47/18; E21B 47/14; E21B 47/185
See application file for complete search history.

(56) References Cited

U.S. PATENT DOCUMENTS 4,608,861 A 9/1986 Wachtler et al.
6,547,016 B2 4/2003 Wassell
(Continued)

FOREIGN PATENT DOCUMENTS

CN 101018926 A 8/2007
RU 2310748 C2 11/2007
(Continued)

OTHER PUBLICATIONS

International Search Report and Written Opinion for PCT/GB2014/051522 dated Jun. 29, 2015.
(Continued)

*Primary Examiner* — James G Sayre
(74) *Attorney, Agent, or Firm* — McDermott Will & Emery LLP

(57) ABSTRACT

Methods of monitoring a force applied to a component (28) in a wellbore (12) following drilling and during a subsequent operation. Methods comprising: providing a string of tubing (35) including a tubular member (46) having at least one sensor (48) for measuring the strain in the tubing, and a device (50) for transmitting data to surface and which is operatively associated with the sensor. Running the string of tubing into the wellbore; monitoring the strain in the tubing measured by the sensor and compensating for the strain. Performing an operation in the well employing the tubing, involving the application of a force to the component in the
(Continued)

wellbore; monitoring the resultant change in strain in the tubing measured by the sensor; and transmitting data relating to the resultant change in strain to surface using the data transmission device, to facilitate determination of the force applied to the component.

12 Claims, 3 Drawing Sheets

(56) References Cited

U.S. PATENT DOCUMENTS

| | | | | |
|---|---|---|---|---|
| 6,957,575 | B2 | 10/2005 | Boucher et al. | |
| 2004/0045351 | A1 | 3/2004 | Skinner | |
| 2005/0167094 | A1* | 8/2005 | Streich | E21B 47/0006 166/66 |
| 2006/0070734 | A1 | 4/2006 | Zillinger et al. | |
| 2009/0071645 | A1* | 3/2009 | Kenison | E21B 44/00 166/250.01 |
| 2010/0319992 | A1 | 12/2010 | Trinh et al. | |

FOREIGN PATENT DOCUMENTS

| | | | | |
|---|---|---|---|---|
| WO | 2004074630 | A1 | 9/2004 | |
| WO | 2006071591 | A2 | 7/2006 | |
| WO | 2009018420 | A2 | 2/2009 | |
| WO | 2011004180 | A2 | 1/2011 | |
| WO | WO 2009018420 | A3 * | 7/2011 | E21B 47/14 |

OTHER PUBLICATIONS

Russian Office Action from Russian Patent Application No. 2015143555, dated Mar. 2, 2017.

Chinese Office Action from Chinese Patent Application No. 201480020814.X, dated Aug. 1. 2017, 16 pages.

* cited by examiner

MONITORING AND TRANSMITTING WELLBORE DATA TO SURFACE

BACKGROUND

The present invention relates to a method of monitoring a force applied to a component in a wellbore following drilling of a wellbore, and to an assembly for use in performing an operation in a well following drilling of a wellbore. In particular, but not exclusively, the present invention relates to a method for monitoring the weight and/or torque applied to a component in a well. The present invention also relates more generally to a method of monitoring a parameter in a wellbore during performance of an operation in a well, which involves operating a fluid pressure pulse generating device to transmit data relating to the change in the at least one parameter to surface.

In the oil and gas exploration and production industry, wellbore fluids comprising oil and/or gas are recovered to surface through a wellbore which is drilled from surface. The wellbore is conventionally drilled using a string of tubing known as a drill string, which includes a drilling assembly that terminates in a drill bit. Drilling fluid known as drilling 'mud' is passed down the string of tubing to the bit, to perform functions including cooling the bit and carrying drill cuttings back to surface along the annulus defined between the wellbore wall and the drill string.

Following drilling, the well construction procedure generally requires that the wellbore be lined with metal wellbore-lining tubing, which is known in the industry as 'casing'. The casing serves numerous purposes, including: supporting the drilled rock formations; preventing undesired ingress/egress of fluid; and providing a pathway through which further tubing and downhole tools can pass. The casing comprises sections of tubing which are coupled together end-to-end. Typically, the wellbore is drilled to a first depth and a casing of a first diameter installed in the drilled wellbore. The casing extends along the length of the drilled wellbore to surface, where it terminates in a wellhead assembly. The casing is sealed in place by pumping 'cement' down the casing, which flows out of the bottom of the casing and along the annulus.

Following appropriate testing, the wellbore is normally extended to a second depth, by drilling a smaller diameter extension of the wellbore through a cement plug at the bottom of the first, larger diameter wellbore section. A smaller diameter second casing is then installed in the extended portion of the wellbore, extending up through the first casing to the wellhead. The second casing is then also cemented in place. This process is repeated as necessary, until the wellbore has been extended to a desired depth, from which access to a rock formation containing hydrocarbons (oil and/or gas) can be achieved. Frequently, a wellbore-lining tubing is located in the wellbore which does not extend to the wellhead, but is tied into and suspended (or 'hung') from the preceding casing section. This tubing is typically referred to in the industry as a 'liner'. The liner is similarly cemented in place within the drilled wellbore. When the casing/liner has been installed and cemented, the well is 'completed' so that well fluids can be recovered, typically by installing a string of production tubing extending to surface.

The well construction procedure which is chosen will depend on factors including physical parameters of the drilled rock formation, the required physical properties of the wellbore (e.g. depth, bore diameter), and other physical characteristics such as the prevailing temperature and hydrostatic pressure. Available options include open hole completions, where the casing is set above the rock formation or zone of interest and well fluids flow into the open casing; liner completions, where a liner is installed across the zone of interest and fluid flows into the liner (through control equipment such as sliding sleeve valves); and perforated casing/liner completions. Whichever construction procedure that is chosen, care must be taken not to apply excessive weight and/or torque to the equipment employed in the construction/completion procedure, particularly the casing/liner.

For example, where a liner is employed, a sealing device known as a packer is provided at the top of the liner, at the interface with the casing. A packer of this type is usually referred to in the industry as a 'liner-top packer'. The packer seals the annular region defined between an external wall of the liner, an internal wall of the larger diameter casing that the liner is located in, and the upper surface of cement that has been supplied into the wellbore to seal the liner. The packer may be carried by the liner or deployed independently, and includes a sealing element which can be deformed radially outwardly into sealing abutment with the wall of the casing. Deformation of the sealing element is typically achieved mechanically, for example by axially compressing the sealing element, by allowing a certain amount of 'weight' to be set down on the packer.

Obtaining verification that the packer has been correctly mechanically set, and so provides an adequate seal, is difficult. In the past, the only way of assessing whether a packer had been correctly set was to monitor the weight applied to the packer at surface, that is the axial load imparted upon the packer to urge the sealing element radially outwardly. However, the weight observed at surface often does not correspond to that experienced by the packer, which may be positioned many hundreds of meters downhole. This is a particular problem in deviated wellbores, where it is difficult to apply the necessary weight to set the packer. It has been found that there can be a considerable reduction of the weight and torque felt by the packer compared to that applied at surface, due to frictional contact with the walls of the wellbore or tubing in the well. Typically, the only indication that a packer had not been set correctly was if an unexpected leak/pressure drop was detected at surface, such as when pressure testing the liner to check for pressure integrity.

Similar difficulties have also been encountered in other steps in wellbore construction activities, where data relating to the activity in question is difficult to obtain.

It has been known to monitor the 'weight on bit' and torque applied during the drilling phase, using sensors (strain gauges) for monitoring these parameters in a drilling environment. However, a particular problem associated with measuring weight on bit is pressure and temperature effects on the measurements taken. In particular, during the drilling phase, mud pumps are switched on to pump the drilling mud down the drill string to the bit from surface, and back up the annulus carrying the cuttings. The pressure inside the tubular drill string is different from the pressure outside the tubular in the annulus—and is typically much higher. This pressure differential causes the body of the tubular to effectively act as a pressure vessel where it elastically deforms under the applied pressure load. This affects the measurements made by weight on bit sensors attached to the tubular. Specifically, the measurement accuracy is dependent on the pressure differential, which is directly correlated to the actual mud flow rates. In addition, when the mud is flowing, the temperature which each strain gauge experiences will vary, and consequently their absolute measurement of the weight and torque will also vary.

Various attempts have been made to correct for these pressure and temperature effects on the measurements, in the hope of enabling accurate weight on bit/torque measurements to be taken.

U.S. Pat. No. 4,608,861 discloses a device with an outer and inner sleeve, for isolating ambient pressure. It discusses the requirement for accurate temperature measurement to eliminate temperature related effects observed by strain gauges.

U.S. Patent Application 2010/0319992 discloses the concept of determining the correct weight on bit by the addition of strain gauges to a drill bit, and also the monitoring of pressure differentials across an effective area of the drill bit while drilling the well bore.

U.S. Pat. No. 6,547,016 discusses the problems associated with a drill string version of strain gauges, and tries to overcome the effects of bending on the measurements by deploying a Wheatstone bridge arrangement of strain gauges, which is a common method in strain gauge technology.

U.S. Pat. No. 6,957,575 discusses the effect of downhole pressure on the weight on bit measurement, and addresses the problem by determining an optimum position for the attachment of strain gauges, where there is null axial strain.

All of these existing documents discuss the problems associated with the deployment and use of sensors in a drilling environment. This presents certain unique challenges. In particular, the prevailing temperature and hydrostatic pressure changes as the drill bit is advanced; the drilling mud is pumped down the string from surface, and the pump pressure can be varied; dynamic errors occur during the drilling process, dependent on factors such as the relative hardness of the formations being drilled and passage of the drill bit through the formations and torque build-up/sudden release in the drill string. These and other issues impact on the ability to accurately measure strain and/or torque in a drill string, as will readily be understood from a review of the prior publications mentioned above.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
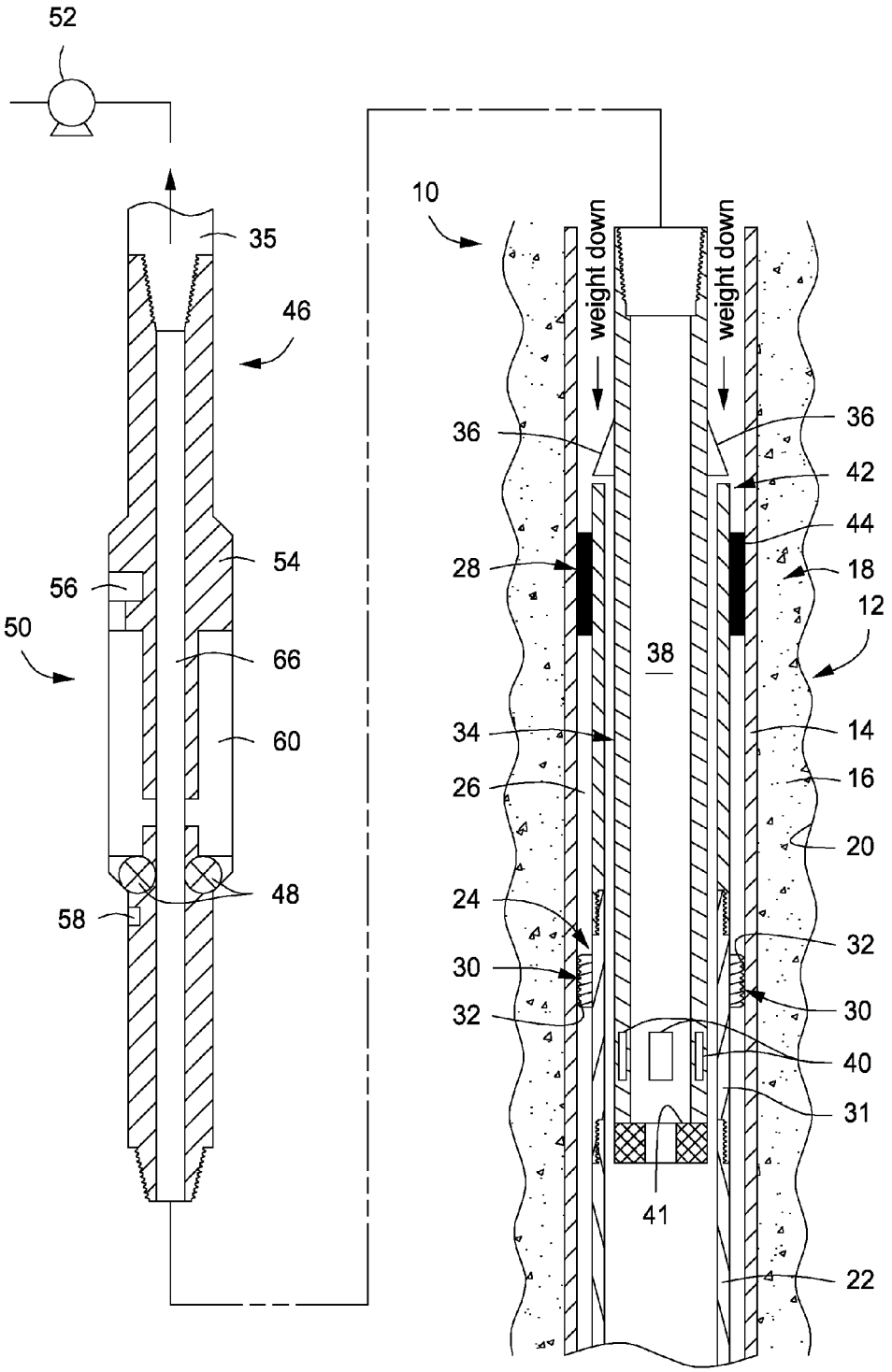
FIG. 1 is a longitudinal cross-sectional view of a well comprising a wellbore which is shown following drilling, and during the performance of a subsequent operation in the well, according to a method of the present invention, the operation in question being the application of a force to a component in the form of a packer, to set the packer in the wellbore, the force applied through a tubing string in the form of a drill pipe.

According to a first aspect of the present invention, there is provided a method of monitoring a force applied to a component in a wellbore following drilling of the wellbore and during a subsequent operation in the well, the method comprising the steps of: providing a string of tubing including a tubular member having at least one sensor for measuring the strain in the tubing, and a device for transmitting data to surface and which is operatively associated with the sensor; running the string of tubing into the wellbore; monitoring the strain in the tubing measured by the sensor and compensating for any residual strain; performing an operation in the well employing the tubing, involving the application of a force to the component in the wellbore; monitoring the resultant change in strain in the tubing measured by the sensor; and, transmitting data relating to the resultant change in strain to surface using the data transmission device, to facilitate determination of the force applied to the component.

According to a second aspect of the present invention, there is provided a method of monitoring a force applied to a component in a wellbore following drilling of the wellbore and during a subsequent operation in the well, the method comprising the steps of: providing a string of tubing including a tubular member having at least one sensor for measuring the strain in the tubing, and a device for generating a fluid pressure pulse downhole which is operatively associated with the sensor; running the string of tubing into the wellbore; activating at least one pump associated with the string of tubing, to supply fluid into the wellbore; waiting a period of time following activation of said pump to allow downhole pressures in the region of the tubular member to stabilize; monitoring the resultant strain in the tubing measured by the sensor and compensating for strain in the tubing resulting from flow induced stress; performing an operation in the well employing the tubing, involving the application of a force to the component in the wellbore; monitoring the resultant change in strain in the tubing measured by the sensor; and, transmitting data relating to the resultant change in strain to surface using the pulse generating device, to facilitate determination of the force applied to the component.

Running of the tubing string into the wellbore, and positioning of the tubing string at a desired location in the wellbore, will result in forces being applied to the tubing. These forces will stress the tubing, stimulating a resultant (or residual) strain. For example, the tubing is suspended from surface, and so experiences tensile loading. The wellbore may deviate from the vertical, so that the tubing experiences bending loads. An interior of the tubing may be isolated from fluid exterior of the tubing, in the annular region which exists between the tubing and the wall of the wellbore (or a larger diameter tubing in which it is located). A pressure differential may therefore exist between the interior and the exterior of the tubing, with resultant fluid pressure loads on the tubing. Indeed, in certain situations it is specifically desired to promote a pressure differential. Even in situations where fluid communication between the interior and exterior of the tubing is permitted, a pressure differential can exist (due, for example, to differences in the densities of fluids in the tubing and in the wellbore).

The invention enables the resultant/residual strain in the tubing to be measured, and then compensated for, prior to the performance of the operation which is to be carried out in the well employing the tubing. As a result, any such strain in the tubing can be accounted for prior to performance of the operation, so that the strain in the tubing which results specifically from performance of the operation (involving the application of a force to a component) can be determined. This enables a determination to be made as to whether the force appropriate to the operation in question has been applied on the component.

The data transmission device may be a device for generating a fluid pressure pulse downhole. The method may comprise the further steps of activating at least one pump associated with the string of tubing, to supply fluid into the wellbore; and waiting a period of time following activation of said pump to allow downhole pressures in the region of the tubular member to stabilize. The step of monitoring the strain may comprise monitoring the resultant (or residual) strain in the tubing measured by the sensor and compensating for strain in the tubing resulting from flow induced stress. The further steps of the method may be carried out prior to performance of the operation in the well. The device may employ the flowing fluid to transmit the data to surface, by way of fluid pressure pulses.

The data transmission device may be arranged to transmit the data to surface acoustically. The device may comprise or may take the form of an acoustic data transmission device and may comprise a primary transmitter associated with the at least one sensor, for transmitting the data. The method may comprise positioning at least one repeater uphole of the primary transmitter, and arranging the repeater to receive a signal transmitted by the primary transmitter and to repeat the signal to transmit the data to surface.

The method may provide the ability to more accurately measure the force applied to a component in a wellbore, during an operation performed subsequent to drilling of the wellbore, when compared to prior techniques involving measuring the force applied at surface. In particular, the method accounts for problems which occur in transmitting the force applied at surface to the component located at depth in the wellbore, especially in deviated wells. In this way, an assessment as to whether a force has been applied to the component which is sufficient for the operation in question can be made. It will be understood that there is a direct correlation between the strain measured in the tubing and the force applied to the downhole component using the tubing. Thus knowledge of the strain facilitates determination of the force.

Typically, the force applied to the component will be that which results from the application of 'weight' to the component (an axial force), the application of torque (a rotary force), or the application of weight and torque. The method may therefore be a method of monitoring at least one of the weight and torque applied to the component. Determination of weight/torque applied may be achievable by appropriate orientation of the at least one strain sensor in the tubular member. The well operation may be any one of a large number of operations which are performed subsequent to drilling of a wellbore. The operation may be one which is required in order to bring a well into production, and may be a well construction operation. The operation may be one which is performed subsequent to bringing a well into production, and may be a well intervention or workover operation.

The well operation may be selected from the group comprising: a) positioning a component at a desired location in the wellbore; b) retrieving a component which has previously been positioned in the wellbore; c) operating a component which has been previously positioned in the wellbore; and d) a combination of two or more of a) to c), for example positioning a component in the wellbore and then operating the component. However, it will be understood that the method may be applicable to further operations in the wellbore not encompassed by the above group, other than those occurring in the wellbore drilling phase.

Possible operations falling within option a) include: setting a wellbore isolation device such as a packer, straddle or valve in the wellbore; positioning a string of tubing (which may be a wellbore-lining tubing such as a liner, expandable tubing such as expandable sandscreen or slotted liner, an intervention or workover string or other tool string) in the wellbore, and which may involve setting a tubing hanger in the wellbore; and positioning a downhole lock in the wellbore, which may optionally carry or be associated with a downhole tool which is to perform a function in the wellbore at a desired location, the lock optionally cooperating with a profile in the wellbore for setting of the lock.

Possible operations falling within option b) include: retrieving a wellbore isolation device such as a packer, straddle or valve from the wellbore; retrieving a wellbore-lining tubing setting/running tool which has been employed to locate a string of tubing in a wellbore; retrieving a string of tubing (which may be a wellbore-lining tubing, an intervention or workover string or other tool string) from the wellbore, and which may involve releasing a tubing hanger from the wellbore; and releasing a downhole lock from the wellbore, which may optionally carry or be associated with a downhole tool which is for performing a function in the wellbore at a desired location, the lock optionally cooperating with a profile in the wellbore. Retrieval of a wellbore-lining tubing setting/running tool in particular may involve the application of an axially directed tensile bad and torque to the tool to release it from the tubing. Knowledge of the axial load and torque is of importance.

Possible operations falling within option c) include: operating a wellbore isolation device such as a packer, straddle or valve previously positioned in the wellbore; setting a tubing hanger in the wellbore to set a string of tubing (which may be a wellbore-lining tubing such as a liner, expandable tubing such as expandable sandscreen or slotted liner, an intervention or workover string or other tool string) in the wellbore; operating a downhole lock to position it in the wellbore, and which may optionally carry or be associated with a downhole tool which is to perform a function in the wellbore at a desired location, the lock optionally cooperating with a profile in the wellbore for setting of the lock; and operating any such downhole tool.

The method may comprise the step of, subsequent to monitoring the strain in the tubing resulting from flow induced stress, transmitting data relating to the strain in the tubing to surface using the pulse generating device. This may facilitate a determination at surface of the compensation which should be applied. The method may comprise the step of, subsequent to monitoring the strain in the tubing resulting from flow induced stress, making a determination of the compensation which should be applied downhole. Such may be achieved using a suitable processor provided as part of the tubing string (typically in the tubular member) and associated with the sensor.

The device for generating a fluid pressure pulse may be located at least partly (and optionally wholly) in a wall of the tubing, and may be a device of the type disclosed in the applicant's International Patent Publication No. W0-2011/004180. A pulse generating device of this type is a 'thru-bore' type device, in which pulses can be generated without restricting a bore of tubing associated with the device. This allows the passage of other equipment, and in particular allows the passage of balls, darts and the like for the actuation of other tools/equipment. Data may be transmitted by means of a plurality of pulses generated by the device, which may be positive or negative pressure pulses. The step of activating the at least one pump may involve activating the pump to supply fluid into the wellbore at a desired telemetry flow rate for the subsequent transmission of data to surface.

The method involves waiting a period of time following activation of said pump to allow downhole pressures in the region of the tubular member to stabilize. Carrying out this step facilitates compensation for the strain in the tubing resulting from flow induced stresses. This is because activating the at least one pump raises the pressure of the fluid in the wellbore, and possibly also the temperature of the fluid, with consequent affects upon the stress felt by the tubing and so resulting strain in the tubing. By waiting a period of time to allow downhole pressures to stabilize, these effects can be compensated for. This is because, once the downhole pressures have stabilized, there will be no (or insignificant) further strain in the tubing resulting from operation of the pump, for a given operating pressure. It will be understood that the period of time which is required to achieve stabilization will depend on numerous factors, which may include depth, hydrostatic pressure, prevailing temperature and/or wellbore geometry. The period of time may be predetermined, optionally taking account of one or more of the above factors. The step of providing a string of tubing may involve providing at least one pressure sensor, optionally in or on the tubular member, and transmitting downhole pressure data to surface using the pulse generating device, which may be associated with said pressure sensor. The pressure sensor may be capable of measuring the pressure within the tubing and/or the pressure in the annular region externally of the tubing. There may be at least two sensors, one for measuring internal pressure and one for measuring external pressure. The extent to which stabilization of the downhole pressures has been achieved can therefore optionally be monitored at surface employing downhole pressure measurements. At least one temperature sensor may be provided, and temperature data transmitted to surface.

Reference is made to downhole pressures. It will be understood that the wellbore will contain fluid, and that fluid which is supplied into the wellbore by the at least one pump will typically be directed down the string of tubing which is run into the wellbore, flowing from the tubing and into an annular region defined between the tubing and a wall of the wellbore (or of a larger diameter tubing within which it is located). There will typically be a pressure differential between the fluid within the tubing and that in the annular region. Reference to the downhole pressures therefore takes account of the fact that the tubing is exposed to such different pressures (this causing the resultant strain).

The step of transmitting the data relating to the resultant change in strain to surface may comprise operating the pulse generating device in an enhanced data transmission mode in which the device generates fluid pressure pulses which are indicative that the desired application force (weight/torque) is being approached, a characteristic of the pulses changing progressively as force (weight/torque) applied increases.

The step of transmitting the data relating to the resultant change in strain to surface may comprise: initially operating the pulse generating device in a first data transmission mode, in which the device generates trains of fluid pressure pulses, the trains of pulses being representative of the actual force (and so optionally weight and/or torque) applied to the downhole component; and on reaching a threshold which is a determined level below the force (weight and/or torque) which is to be applied to the component, operating the pulse generating device in a second (enhanced) data transmission mode, in which the device generates fluid pressure pulses which are indicative that the desired application force (weight/torque) is being approached, a characteristic of the pulses changing progressively as force (weight/torque) applied increases.

The characteristic which changes as the force applied increases may be a dwell time between the pulses. Thus the dwell time between the pulses generated in the enhanced/second data transmission mode may change progressively as force (weight/torque) applied increases. The duration of the pulses may be substantially constant.

The characteristic which changes as the force applied increases may be a duration of the pulses. Thus the duration of the pulses generated in the enhanced/second data transmission mode may change progressively as force (weight/torque) applied increases. A dwell time between the pukes generated in the enhanced/second data transmission mode may be substantially constant.

Optionally a dwell time and pulse duration may change progressively in the enhanced/second data transmission mode.

A dwell time between the pulses generated in the enhanced/second data transmission mode may be employed to transmit data. The dwell time may represent a particular parameter or parameters measured downhole. A dwell time of a specific duration may be indicative of a particular downhole parameter measurement, for example, a particular pressure or temperature in the wellbore.

The dwell time between pulses or pulse duration may change when the force which is to be applied is reached. Unique dwell times or pulse durations may be employed as further force is applied, to provide such an indication. Forces of the same magnitude below and above the desired force may have different dwell times. For example, a force of 2000 lb below the desired force may have a dwell time between pulses of 5 seconds, whereas a force of 2000 lb above the desired force may have a dwell time which differs by say 0.5 seconds and so a dwell time of 5.5 seconds. Observation of pulses at 5.5 second spacings indicates that the force has been exceeded by 2000 lb.

As will be understood by persons skilled in the art, pulses generated by a fluid pressure pulse device in a wellbore are transmitted to surface within fluid in the wellbore. The pulses take a period of time of the order of several seconds to travel to surface, this depending particularly on wellbore depth. Trains of such pulses representing the force (e.g. weight/torque) applied to a component are detected at surface and, using a suitable processor, the force value represented by the train of pulses can be derived. The delay in pulse transmission could result in the over-application of force on the downhole component, with possible consequences including damage to and/or dislodgement of the component from its position in the wellbore. This is particularly the case when the pulse trains represent a relatively large parameter, such as the applied weight, which may be of the order of tens of thousands of lbs.

The present invention can address this problem. This is because, typically, the pulses generated in the enhanced/second data transmission mode will be of significantly shorter duration than the pulse trains generated in the first data transmission mode. Pulse trains generated during operation in the first transmission mode will typically be relatively long, comprising a series of positive or negative fluid pressure pulses, representative of the measured force (e.g. weight and/or torque). During the initial application of force, the resultant delay in data transmission is not of great significance, as the continued application of force which occurs in the period between issuance of the pulse train, and transmission of the pulse train to surface, will not normally result in the desired force being reached. However, when the applied force comes closer to the desired level, this delay could result in the over application discussed above.

Operating the device in the enhanced/second data transmission mode may address this in two ways: 1) the pulses generated are of shorter duration; and 2) the characteristic of the pulses (e.g. the dwell time between the pulses which are generated, and/or the duration of the pulses themselves) changes progressively as force applied increases, giving the operator an indication that the desired level is being approached. This allows the operator to reduce the rate of increase of force (e.g. weight/torque) being applied at surface, so that the desired setting level is approached in a more controlled manner.

In the enhanced/second data transmission mode, the dwell time between the pulses, or the pulse durations, may correlate to the amount of the difference between the measured force (e.g. weight/torque) and the desired level.

The dwell time between the pulses generated in the enhanced/second transmission mode, or the pulse durations, may reduce in duration as the desired force to be applied is approached. This means that the closer that the operator gets to the desired force, the shorter is the dwell time or the pulses which are generated. In the event that the desired force level is reached and continued application of force occurs, the dwell time or the duration of the pulses generated may start to increase in duration. This means that the further the operator goes beyond the desired force, the longer is the dwell time or the duration of the pulses which are generated. This may provide feedback to the operator that the desired level has been reached, and that continued application of force should cease.

In the enhanced/second data transmission mode, the pulse generating device may issue a constant stream of pulses indicative of the difference between the threshold force and the force which is to be applied to the component. It will be understood that, in the enhanced/second data transmission mode, if the application of further force is halted, the device will continue to issue a stream of pulses without variation in the characteristic (e.g. dwell time between the pulses and/or pulse duration).

The step of transmitting the data may comprise the further step of setting a second/high threshold which is a determined level above the force (weight and/or torque) which is to be applied to the component and, on reaching the second threshold, returning the pulse generating device to operate in the first data transmission mode. The second or high threshold may represent a safe maximum force which can be applied to the component without consequences such as those discussed above, and provides a firm indication of the actual force applied on the component to the operator at surface. This may help to prevent the accidental over application of force.

The characteristic of the pulses generated in the enhanced/second transmission mode (e.g. the dwell time between the pulses, or the duration of the pulses) may increase in duration as the desired force to be applied is approached. This means that the closer that the operator gets to the desired force, the longer is the dwell time or the duration of the pulses which are generated. In the event that the desired force level is reached and continued application of force occurs, the dwell time or the duration of the pulses generated may start to reduce in duration. This means that the further that the operator goes beyond the desired force, the shorter is the dwell time or the duration of the pulses which are generated. This may provide feedback to the operator that the desired level has been reached, and that continued application of force should cease.

A dedicated pulse or train of pulses may be generated when the desired force has been reached. This may be a pulse of dedicated duration, or a train of pulses of a dedicated profile. Issuance of the pulse or pulse train may provide a firm indication to the operator that the desired force has been reached. The generation of pulses may cease when the desired force has been reached.

In the first data transmission mode, the method may comprise issuing trains of pressure pulses at determined intervals of applied force (e.g. every one thousand or two thousand lbf).

In the enhanced/second data transmission mode, the method may comprise issuing pressure pulses having a characteristic which corresponds to a predetermined applied force (e.g. a dwell time between pulses of 6.5 seconds duration indicating that the weight is within 10,000 lbs of target, reducing by 0.5 seconds per additional 2,000 lbs applied until the desired 'weight' i.e. applied force is reached).

The trains of fluid pressure pulses generated by the device in the first transmission mode may be the actual force (where determination of same occurs in the wellbore), or the resultant change in strain (where determination of the force applied occurs at surface).

It will be understood that the threshold may be determined taking account of a number of different factors, chief of which may be: the depth at which the component is located in the wellbore; and the force which is to be applied. Other factors which may be taken into account could include hydrostatic pressure; applied pump pressure; density of fluids in the wellbore (in the string of tubing and/or in the annulus); and the prevailing temperature at depth. The threshold may be at least about 70% of the force (e.g. weight/torque) to be applied to the downhole component, and may be no more than about 95% of the force.

Optionally the threshold may be between about 80% and about 90% of the force to be applied.

There may be a plurality of strain sensors, spaced around a periphery of the tubular member. The at least one sensor may be mounted in a wall of the tubular member. The tubular member may be coupled into a string of tubing coupled together end-to-end and making up the tubing string. The tubular member may be coupled to a coiled tubing. The term tubing 'string' should be interpreted accordingly. The tubular member may carry the pulse generating device, which may be mounted in a wall of the tubular member.

The method may comprise storing the strain data in a memory device provided in the tubing, typically in the tubular member; retrieving the tubing to surface following completion of the operation; downloading the data stored in the device; and performing a more detailed assessment of the force applied to the component. This may facilitate verification that the desired force has indeed been applied.

According to a third aspect of the present invention, there is provided an assembly for use in performing an operation in a well following drilling of a wellbore, the assembly comprising: a component for performing an operation in the well following drilling of the wellbore; and an apparatus for sensing a force applied to the component, the apparatus comprising: a tubular member which can be provided in a string of tubing that can be located in the wellbore, the tubing arranged to impart the force on the component; and at least one sensor for measuring the strain in the tubing during application of the force on the component, said sensor mounted in a wall of the tubular member.

The assembly may also comprise a device for transmitting data to surface which is operatively associated with the sensor, for transmitting data relating to the strain in the tubing to surface, said strain being indicative of the force applied to the component. The force may result from the application of at least one of weight and torque to the component. The transmission of data to surface relating to the strain in the tubing may facilitate determination of at least one of the weight and the torque applied to the component.

The data transmission device may be a device for generating a fluid pressure pulse downhole.

The data transmission device may be arranged to transmit the data to surface acoustically.

The device may comprise or may take the form of an acoustic data transmission device.

Further features of the assembly may be derived from the text above relating to the method of the first and/or second aspect of the invention.

According to a fourth aspect of the present invention, there is provided a method of monitoring a parameter in a wellbore during performance of an operation in the well, the method comprising the steps of: monitoring at least one parameter in a wellbore; performing an operation in the wellbore; monitoring a change in the at least one parameter resulting from performance of the operation; and operating a fluid pressure pulse generating device located in the wellbore to transmit data relating to the resultant change in the at least one parameter to surface; in which the step of operating the pulse generating device comprises arranging the device to operate in an enhanced data transmission mode, in which the device generates fluid pressure pulses which are indicative that the desired level is being approached, a characteristic of the pulses progressively changing as the desired level is approached.

The step of operating the pulse generating device comprises arranging the device to operate: in a first data transmission mode, in which the device generates trains of fluid pressure pulses, the trains of pulses being representative of the at least one measured parameter; and on reaching a threshold which is a determined amount above or below a desired level for the at least one parameter, operating the pulse generating device in the enhanced data transmission mode, in which the device generates fluid pressure pulses which are indicative that the desired level is being approached, a characteristic of the pulses progressively changing as the desired level is approached.

The enhanced data transmission mode may therefore be a second data transmission mode.

The method of the fourth aspect of the invention has a utility for monitoring a wide range of different parameters in a wellbore, and changes in such parameters resulting from performance of the operation in question. The parameter may be selected from the group comprising: 1) a force applied to a component employed to perform an operation; 2) pressure (in the tubing and/or in the annular region between the tubing and the wellbore); 3) temperature; and 4) well geometry parameters.

Possible operations affecting parameters falling within option 1) include the application of a force (e.g. through application of weight and/or torque) to the component. One suitable example is the application of weight and/or torque to set a wellbore isolation device in the wellbore, which may be a straddle, packer or valve.

Possible operations affecting parameter 2) include actuating a wellbore isolation device to open or close flow to or from part of a wellbore, such resulting in a change in downhole pressure(s).

Possible operations affecting parameter 3) include actuating a wellbore isolation device to open or close flow to or from part of a wellbore, such resulting in a change in downhole temperature(s).

Possible operations affecting parameters falling within option 4) include deviating a drilling or milling tool from the vertical, such affecting wellbore inclination and/or azimuth (position on a compass relative to north).

The skilled person will readily appreciate other possible parameters which might be monitored in the method of the fourth aspect of the invention, and which may change as a result of performing an operation in a wellbore.

Further aspects of the invention may combine one or more feature of one or more of the above described aspects of the invention. In particular, further features of the method of the fourth aspect of the invention may be derived from the text relating to the first and/or second aspect of the invention concerning operation of the pulse generating device in its enhanced or first and second data transmission modes.

Embodiments of the present invention will now be described, by way of example only, with reference to the accompanying drawings.

FIG. 1 is a longitudinal cross-sectional view of a well comprising a wellbore which is shown following drilling, and during the performance of a subsequent operation in the well, according to a method of the present invention, the operation in question being the application of a force to a component in the form of a packer, to set the packer in the wellbore, the force applied through a tubing string in the form of a drill pipe.

Figure 2:
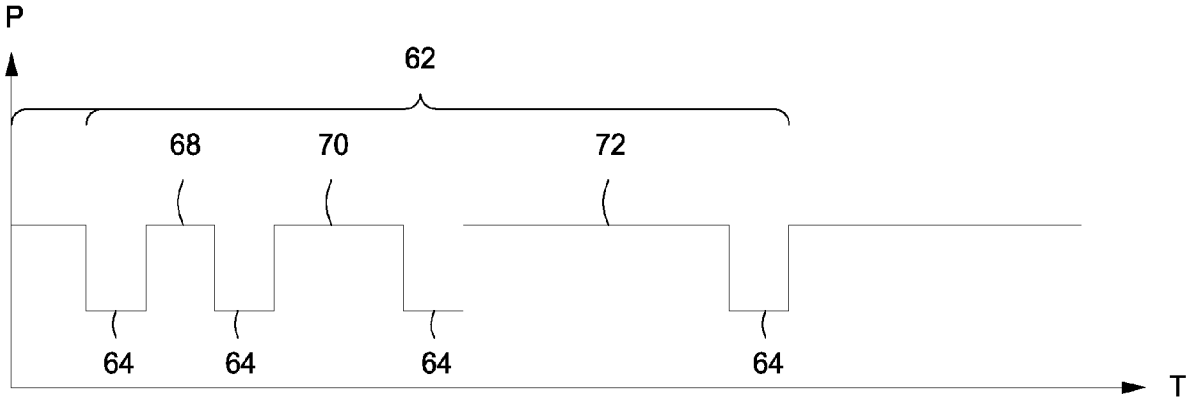
FIG. 2 is a graph showing an exemplary pulse train generated by a data transmission device in the form of a fluid pressure pulse generating device in the method of FIG. 1, the graph illustrating operation of the pulse generating device in a first data transmission mode.

FIG. 2 is a graph showing an exemplary pulse train generated by a data transmission device in the form of a fluid pressure pulse generating device in the method of FIG. 1, the graph illustrating operation of the pulse generating device in a first data transmission mode.

Figure 3:
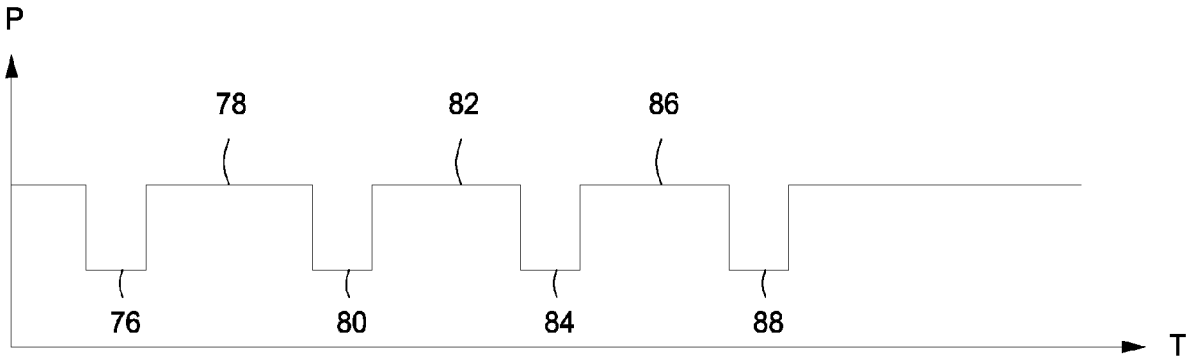
FIG. 3 is a graph showing an exemplary series of pulses generated by the fluid pressure pulse generating device during operation in a second or enhanced data transmission mode.

FIG. 3 is a graph showing an exemplary series of pulses generated by the fluid pressure pulse generating device during operation in a second or enhanced data transmission mode.

Turning firstly to FIG. 1, there is shown a longitudinal cross-sectional view of a well 10 comprising a wellbore 12 which is shown following drilling, and during the performance of a subsequent operation in the well.

The wellbore 12 has been drilled from surface in a conventional fashion, and a first wellbore-lining tubing in the form of a casing 14 located in the wellbore and cemented in place by means of cement 16 supplied into an annular region 18 disposed between the casing 14 and a wall 20 of the wellbore 12. The casing 14 extends to a wellhead (not shown) at surface, as is known in the art, and performs numerous functions. It will be appreciated that further smaller diameter casings may be positioned in the wellbore, extending up through the first casing 14 to the wellhead. However, only the single casing 14 is shown, for ease of illustration.

In the illustrated embodiment, the operation which is being performed is a well construction operation, involving the location of a further wellbore-lining tubing in the form of a liner 22 in the well bore 12. The liner 22 is suspended and so 'hung' from the casing 14, and extends into an open-hole or uncased portion of the wellbore 12 below the casing 14.

The liner 22 is hung from the casing 14 employing a liner hanger 24, and an annular region 26 between the casing 14 and the liner 22 is sealed using an expandable sealing device in the form of a liner-top packer 28. Following actuation of the liner hanger 24 (which will be described below), the liner 22 is cemented in place within the wellbore 12, and the packer 28 actuated to seal the annular region 26, preventing fluid migration along the annular region past the liner 22.

The liner hanger 24 is hydraulically actuated, and comprises a plurality of slips, two of which are shown and given the reference numeral 30. The slips 30 are hydraulically operated to move radially outwardly from retracted positions out of engagement with the casing 14, to extended positions (shown in the drawing) in which they engage the casing 14, so that the liner 22 is suspended from the casing. The slips 30 each take the form of pistons which are moveably mounted in a body 31 of the hanger 24, and have serrated faces 32 which engage the wall of the casing 14. The slips 30 are urged outwardly to engage the casing 14 by applied fluid pressure.

The liner 22 carrying the liner hanger 24 and liner-top packer 28 is run into the wellbore 12, and positioned within the casing 14, via a liner hanger running/setting tool 34, which is suspended from a drill pipe 35 or other tubing string. The running tool 34 includes a plurality of engaging elements in the form of dogs, two of which are shown and given the reference numeral 36. During running-in, the dogs 36 are engaged with an internal profile (not shown) of the liner hanger 24, to support the liner hanger 24 and thus the liner 22 which is coupled to the hanger. The liner hanger 24 is set by raising the pressure of fluid in the drill pipe 35, and thus a bore 38 of the running tool 34, this pressure being communicated to the hanger slips 30 via ports 40 in a wall of the running tool. This may involve first inserting a ball, dart or the like (not shown) into the drill string bore 38 at surface, the ball passing down the string and landing on a seat 41 provided at the lower end of the string. This closes flow through the string bore 38 so that the fluid behind the ball can be pressured-up, to set the hanger slips 30. After the slips 30 have been set, further application of pressure blows the ball through the seat 41 and on down the wellbore, to reopen fluid communication through the string bore 38.

The liner 22 is then suspended from the casing 14, and the running tool 34 can be released from the liner hanger 24 by disengaging the dogs 36 from the liner hanger internal profile. This is achieved in a known fashion, by the application of a predetermined axial force and/or torque to the running tool 34 through the associated drill pipe 35. As will be evident from the following description, the method and assembly of the invention has a utility in the release of the running tool 34 from the liner hanger 24.

The running tool 34 is then pulled back uphole to a position where the dogs 36 (which are typically spring loaded) are uphole of a top 42 of the liner 22. The dogs 36 move radially outwardly, and the running tool 34 can then be moved back downhole until they engage the liner top 42. An axial force can then be applied to set the packer 28, in a known fashion, by setting down 'weight' on the packer 28. The drill pipe 35 and running tool 34 are suspended from surface, and the procedure effectively involves allowing a portion (or all) of the weight of the pipe and running tool 34 to be set down on to the packer 28. This axially compresses an expandable sealing element 44 of the packer 28, urging it radially outwardly into sealing abutment with the casing 14. Setting of the packer 28 may additionally or alternatively involve the application of torque to the packer. Once again, the method and assembly of the invention has a utility in setting of the packer 28.

In particular, it is desirable to have a means of accurately measuring the force (weight and/or torque) applied to the liner hanger running tool 34 to release it from the liner hanger 24, and to the packer 28 to set it, and of transmitting corresponding data to surface. The method and assembly of the present invention, which will now be described, provides a means of achieving this.

Accordingly, in an embodiment of the invention, there is provided a method of monitoring a force applied to a component in a wellbore following drilling of the wellbore and during a subsequent operation in the well. The method will be described in relation to the setting of the packer 28 shown in FIG. 1, but applies equally in relation to the recovery of the running tool 34 or indeed in other well operations.

The method comprises the steps of providing a string of tubing, in this case the drill pipe 35, including a tubular member 46 having at least one sensor for measuring the strain in the drill pipe 35, two such strain sensors being shown and given the reference numeral 48. Typically there will be at least three such strain sensors 48, and optionally four or more, spaced around a perimeter of the tubular member 46. The tubular member 46 also includes a device for transmitting data to surface which is operatively associated with the sensor, the device indicated generally by reference numeral 50. In this embodiment, the data transmission device 50 takes the form of a device for generating a fluid pressure pulse. The method employing the pulse generating device 50 involves running the drill pipe 35 carrying the tubular member 46 into the wellbore 12, in this case as part of the procedure for deploying the liner 22. A pump 52 at surface is associated with the drill pipe 35, and is activated to supply fluid into the wellbore 12 along the drill pipe. The method involves waiting a period of time following activation of the pump 52, to allow downhole pressures in the region of the tubular member 46 to stabilize. The resultant (or residual) strain in the drill pipe 35 is measured by the sensors 48, and strain in the drill pipe 35 resulting from flow induced stress is compensated for.

The desired operation in the well 10 is then performed employing the drill pipe 35, which in this embodiment is the setting of the packer 28, involving the application of a force to the packer positioned in the wellbore 12. The resultant change in strain in the drill pipe 35 is measured by the strain sensors 48, and data relating to the resultant change in strain transmitted to surface using the pulse generating device 50. This facilitates determination of the force applied to the packer 28, so that an assessment can be made as to whether the force necessary to correctly set the packer has been applied. It will be understood that there is a direct correlation between the strain measured in the drill pipe 35 and the force applied to the packer 28 through the drill pipe. Thus knowledge of the strain facilitates determination of the force. As mentioned above, the force applied to the packer 28 may be that which results from the application of 'weight' to the component (an axially directed force), the application of torque (a rotary force), or the application of weight and torque. Determination of weight/torque applied is achievable by appropriate orientation of the strain sensors 48 in the tubular member 46.

The pulse generating device 50 is located in a wall 54 of the tubular member 46, and is a device of the type disclosed in the applicant's International Patent Publication No. W0-2011/004180, the disclosure of which is incorporated herein by way of reference. A pulse generating device 50 of this type is a 'through-bore' type device, in which pulses can be generated without restricting a bore of tubing associated with the device. This allows the passage of other equipment, and in particular allows the passage of balls, darts and the like for the actuation of other tools/equipment. Data is transmitted by means of a plurality of pulses generated by the device 50, which may be positive or negative pressure pulses.

Data relating to the strain in the drill pipe 35 resulting from flow induced stress may be transmitted to surface using the pulse generating device 50, to facilitate a determination at surface of the compensation which should be applied. However, the method will typically involve a determination of the compensation which should be applied downhole using a suitable processor 56 provided in the tubular member 46 and associated with the sensors 48.

The pump 52 is activated to supply fluid into the wellbore at a desired telemetry flow rate for the subsequent transmission of data to surface. Waiting for downhole pressures in the region of the tubular member 46 to stabilize facilitates compensation for the strain in the drill pipe 35 resulting from flow induced stresses. This is because activating the pump 52 raises the pressure of the fluid in the wellbore 10, and possibly also the temperature of the fluid, with consequent affects upon the stress felt by the drill pipe 35 and so resulting strain in the pipe. By waiting a period of time to allow downhole pressures to stabilize, these effects can be compensated for. This is because, once the downhole pressures have stabilized, there will be no (or insignificant) further strain in the drill pipe 35 resulting from operation of the pump 52, for a given operating pressure. It will be understood that the period of time which is required to achieve stabilization will depend on numerous factors, which may include depth, hydrostatic pressure, prevailing temperature and/or wellbore geometry. The period of time is predetermined, taking account of one or more of the above factors.

A pressure sensor 58 is optionally provided in the tubular member 46, for measuring the downhole pressure in the region of the tubular member (within the drill pipe 35 and/or the pressure in the annular region externally of the drill pipe). The measured pressure data can be transmitted to surface using the pulse generating device 50, which is associated with the pressure sensor 58. The extent to which stabilisation of the downhole pressures has been achieved can therefore optionally be monitored at surface employing the downhole pressure measurements. A temperature sensor may also be provided, and temperature data transmitted to surface in the same way.

The pulse generating device 50 is provided as a cartridge which is releasably mounted in the wall 54 of the tubular member 46, and includes a battery or other onboard power source which provides power for operating the device. Typically the battery will be provided integrally with the device 50, but may be provided separately in the tubular member 46 and coupled to the device. In a similar fashion, a battery 60 or other onboard power source is provided for the sensors 48 and the processor 56 (although the processor may be powered by the battery in the device 50). The sensors 48 are all coupled to the processor 56 via wiring extending along channels in the tubular member 46, following the teachings of U.S. Pat. No. 6,547,016, the disclosure of which is incorporated herein by way of reference. Optionally, the battery 60 can provide power for operation of the pulser 50.

The measured strain data is communicated from the sensors 48 to the processor 56, which performs a calculation of the compensation required to account for the strain in the drill pipe 35 resulting from the flow induced stress. Once these effects have been nulled, subsequent strain in the drill pipe 35 measured by the sensors 48 is monitored and transmitted to surface as discussed above. The data relating to the resultant change in strain can be transmitted to surface as follows.

The pulse generating device 50 can be arranged to be operated in an enhanced data transmission mode, in which the device generates fluid pressure pulses which are indicative that the desired application force (weight/torque) is being approached, a characteristic of the pulses changing progressively as force applied increases.

In one operating scenario, the step of transmitting the data relating to the resultant change in strain to surface involves initially operating the pulse generating device 50 in a first data transmission mode, in which the device generates trains of fluid pressure pulses, the trains of pulses being representative of the actual force (and so optionally weight and/or torque) applied to the packer 28. FIG. 2 is a graph showing one such exemplary pulse train 62, representing the force applied to the packer 28 through the drill pipe 35 to set the packer, in this case an axial force applied by setting weight down on the packer 28 without rotation.

The pulse train 62 comprises a series of negative pressure pulses 64 of similar magnitude, which are generated by the pulser 50, by selectively opening fluid communication between an inner bore 66 of the tubular member 46 and the exterior of the tubular member, following the teachings of W0-2011/004180. The spacings or 'dwell times' between the various pulses 64 are indicated variously by numerals 68, 70 and 72. This combination of pulses 64 and dwell times 68 to 72 is an encoded signal which represents the weight set down on the packer 28. The pulse train signal 62 is recognized by a processor at surface (not shown) and converted, using appropriate software, back into a force reading which can be viewed by the operator.

As can be appreciated from FIG. 2, the pulse train 62 is relatively long, typically of the order of several seconds. Furthermore, the pulse train 62 takes a period of time to transit through the fluid in the wellbore 10 to surface. Accordingly, in the method of the invention, a threshold is defined which is a determined level below the force which is to be applied to the packer 28. On reaching the threshold force level, the device 50 is arranged to operate in a second (enhanced) data transmission mode, in which the device generates fluid pressure pulses which are indicative that the desired application force is being approached. In this second data transmission mode, a characteristic of the pulses changes progressively as force applied increases.

This is illustrated in FIG. 3, which is a graph showing an exemplary series of pulses generated by the pulser 50 during operation in the second (enhanced) data transmission mode. Starting at the left-hand side, a first pulse 76 is issued by the pulser 50, with a dwell time 78 between the first pulse 76 and a second pulse 80. The characteristic which changes as the force applied increases is, in this example, the dwell time between the pulses. Thus the dwell time between the pulses generated in the second data transmission mode changes progressively as force (weight) applied to the packer 28 increases. In this instance, the dwell time decreases with increased force applied. The duration of the pulses themselves, and indeed the pulse magnitude, is substantially constant. It will be understood however that the characteristic which changes may be the duration of the pulses themselves, or conceivably both dwell time and pulse duration.

In the event that the application of further weight to the packer 28 is halted, a continuous stream of pulses will be generated having the same dwell time 78. However, FIG. 3 illustrates the situation where the weight set down on the packer 78 is progressively increasing. In this situation, the dwell times between pulses shortens as the desired setting force is approached. This is shown in the Figure by the shorter dwell time 82 between the second pulse 80 and a third pulse 84, and further in the still shorter dwell time 86 between the third pulse 84 and a fourth pulse 88.

During the initial application of force to the packer 28, the resultant delay in data transmission is not of great significance, as the continued application of force which occurs in the period between issuance of the pulse train, and transmission of the pulse train to surface, will not normally result in the desired force being reached. However, when the applied force comes closer to the desired level, this delay could result in the over application of force to the packer 28. Operating the pulse generating device 50 in the second data transmission mode addresses this in two ways: 1) the pulses generated are of shorter duration; and 2) the characteristic of the pulses, that is the dwell time between the pulses which are generated, changes progressively as force applied increases, giving the operator an indication that the desired level is being approached. This allows the operator to reduce the rate of increase of force being applied at surface, so that the desired setting level is approached in a more controlled manner.

In the second data transmission mode, the dwell times 78, 82, 86 between the pulses 76, 80, 84, 88 correlates to the amount of the difference between the measured force applied to the packer 28 and the desired level. Also, the dwell times between the pulses generated in the second transmission mode reduce in duration as the desired force to be applied is approached. This means that the closer that the operator gets to the desired force, the shorter is the dwell time (or conceivably the pulses which are generated). In the event that the desired force level is reached and continued application of force occurs, the dwell time (or pulse length) may be arranged so that it starts to increase in duration. This means that the further the operator goes beyond the desired setting force, the longer is the dwell time between the pulses which are generated. This provides feedback to the operator that the desired level has been reached, and that continued application of force to the packer 28 should cease.

By way of example, a setting force (weight) to be applied to the packer 28 to set it, also known as the 'set point', may be 40,000 lbs. A threshold or 'trigger point' for changing from the first data transmission mode to the second data transmission mode may be set at 32,000 lbs. At initial start-up, standard 'synch' and 'reference' pulses are issued by the pulser 50, informing the processor at surface that subsequent pulse trains will be representative of the actual force applied to the packer 28, in the first data transmission mode (per FIG. 2). Trains of pressure pulses are then issued at determined intervals of applied force, e.g. every one thousand or two thousand lbs of applied force. As the force applied to the packer 28 increases and the threshold or set point is reached, the pulser starts to operate in the second data transmission mode, operation in the second mode being controlled either onboard the pulser 50 or via the processor 56. This represents a faster relative encoding format which signifies the variation of the measured parameter (force; weight and/or torque) from the trigger point. The closer the set point, the faster the data update.

It will be understood that the threshold or set point may be determined taking account of a number of different factors, chief of which may be the depth at which the component is located in the wellbore, and the force which is to be applied. Other factors which may be taken into account could include hydrostatic pressure; applied pump pressure; density of fluids in the wellbore (in the string of tubing and/or in the annulus); and the prevailing temperature at depth. The threshold may be at least about 70% of the force to be applied to the downhole component, and may be no more than about 95% of the force. Optionally the threshold may be between about 80% and about 90% of the force to be applied. In the enhanced/second data transmission mode, the method involves issuing pressure pulses having a characteristic which corresponds to a predetermined applied force (e.g. a dwell time between pulses of 6.5 seconds duration indicating that the weight is within 10,000 lbs of target, reducing by 0.5 seconds per additional 2,000 lbs applied until the desired 'weight' i.e. applied force is reached).

This is further illustrated in the following table, which provides examples of the weight and time between pulses when operating in first and second operating modes, and in particular of the pulse and dwell time durations in the second data transmission mode:

| Weight | Time between pulses |
|---|---|
| Below trigger point (32000 lbs) | Normal full transmission sequences (pulse chains) |
| Above trigger point | Pulse width is 0.75 seconds |
| 32000 | 6.5 (dwell time) |
| 34000 | 6 |
| 38000 | 5.5 |
| 40000 | 5 |
| Above Set Point | Pulse width is now 1.0 seconds |
| 42000 | 5.5 |
| 44000 | 6 |
| 46000 | 6.5 |

The above coding allows the fastest update rate around the set point. Whether the weight applied is below or above the set point is determined, in this case, by the width of the pulse which changes from 0.75 to 1 second. The time between pulses is a measure of the data variable deviation from the set point.

The step of transmitting the data may comprise the further step of setting a second/high threshold that is a determined level above the force which is to be applied to the packer 28 and, on reaching the second threshold, returning the pulse generating device to operate in the first data transmission mode. The second or high threshold may represent a safe maximum force that can be applied to the packer 28 without consequences such as those discussed above, and provides a firm indication of the actual force applied on the packer 28 to the operator at surface. This may help to prevent the accidental over application of force.

The characteristic of the pulses generated in the enhanced/second transmission mode (e.g. the dwell time between the pulses, and/or the duration of the pulses) may alternatively be arranged so that they increase in duration as the desired force to be applied is approached. This means that the closer that the operator gets to the desired force, the longer is the dwell time or the duration of the pulses which are generated. In the event that the desired force level is reached and continued application of force occurs, the dwell time or the duration of the pulses generated may start to reduce in duration. This means that the further that the operator goes beyond the desired force, the shorter is the dwell time (and/or the duration of the pulses which are generated). This may provide feedback to the operator that the desired level has been reached, and that continued application of force should cease.

A dedicated pulse or train of pulses may be generated when the desired force has been reached, and so at the set point. This may be a pulse of dedicated duration, or a train of pulses of a dedicated profile. Issuance of the pulse or pulse train may provide a firm indication to the operator that the desired force has been reached. The generation of pulses may cease when the desired force has been reached.

Optionally, the strain/force data may be stored in a memory device provided in the drill pipe 35, typically in the tubular member 46, such as in the processor 56. Following completion of the operation in the wellbore 10 (setting of the packer 28), the drill pipe 35 is retrieved to surface, and the stored data retrieved. This allows a more detailed assessment of the force applied to the packer 28 to be carried out, which may facilitate verification that the desired force has indeed been applied.

Figure 4:
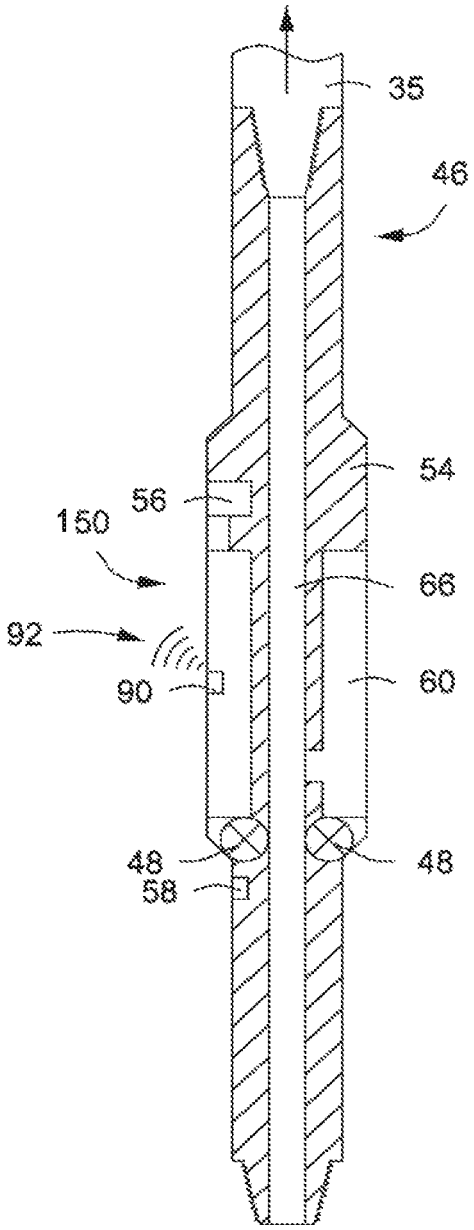
FIG. 4 is a variation on the embodiment shown and described in FIGS. 1 to 3, in which the tubular member is provided with an alternative data transmission device.

Turning now to FIG. 4, there is shown a variation on the embodiment shown and described in FIGS. 1 to 3, in which the tubular member 46 is provided with an alternative data transmission device, indicated generally by reference numeral 150. In this embodiment, the data transmission device 150 is arranged to transmit the strain/force data to surface acoustically, and takes the form of an acoustic data transmission device.

The acoustic device 150 is mounted in the tubular member 46 in a similar way to the pulse generating device 50, in the wall 54 of the tubular member. In this way, the acoustic device 150 similarly does not impede the inner bore 66. Power for operation of the acoustic device 150, and other components including processor 56 and sensors 48 and 58, is again provided by battery 60.

The acoustic device 150 comprises a primary transmitter 90 associated with the strain sensors 48, for transmitting the data to surface via acoustic sound waves, indicated schematically at 92 in the drawing. One or more signal repeaters (not shown) may be positioned uphole of the primary transmitter 90, and arranged to receive the signal 92 transmitted by the primary transmitter 90 and to repeat the signal to transmit the data to surface.

Whilst the preceding description relates to the setting of the packer 28, it will be understood that the principles of the invention also apply to the monitoring of force (weight and/or torque) imparted on the liner hanger running tool 34 to release it from the liner hanger 24 following actuation of the hanger, by exertion of an axial pull force and/or torque on the running tool.

Further, it will be understood that the well operation which is performed may be any one of a large number of operations which are performed subsequent to drilling of a wellbore. The operation may be one which is required in order to bring a well into production, and may be a well construction operation. The operation may be one which is performed subsequent to bringing a well into production, and may be a well intervention or workover operation.

The well operation may be selected from the group comprising: a) positioning a component at a desired location in the wellbore; b) retrieving a component which has previously been positioned in the wellbore; c) operating a component which has been previously positioned in the wellbore; and d) a combination of two or more of a) to c), for example positioning a component in the wellbore and then operating the component. However, it will be understood that the method may be applicable to further operations in the wellbore not encompassed by the above group, other than those occurring in the wellbore drilling phase.

Possible operations falling within option a) include: setting a wellbore isolation device such as a packer, straddle or valve in the wellbore; positioning a string of tubing (which may be a wellbore-lining tubing such as a liner, expandable tubing such as expandable sandscreen or slotted liner, an intervention or workover string or other tool string) in the wellbore, and which may involve setting a tubing hanger in the wellbore; and positioning a downhole lock in the wellbore, which may optionally carry or be associated with a downhole tool which is to perform a function in the wellbore at a desired location, the lock optionally cooperating with a profile in the wellbore for setting of the lock.

Possible operations falling within option b) include: retrieving a wellbore isolation device such as a packer, straddle or valve from the wellbore; retrieving a wellbore-lining tubing setting/running tool which has been employed to locate a string of tubing in a wellbore; retrieving a string of tubing (which may be a wellbore-lining tubing, an intervention or workover string or other tool string) from the wellbore, and which may involve releasing a tubing hanger from the wellbore; and releasing a downhole lock from the wellbore, which may optionally carry or be associated with a downhole tool which is for performing a function in the wellbore at a desired location, the lock optionally cooperating with a profile in the wellbore. Retrieval of a wellbore-lining tubing setting/running tool in particular may involve the application of an axially directed tensile load and torque to the tool to release it from the tubing. Knowledge of the axial load and torque is of importance.

Possible operations falling within option c) include: operating a wellbore isolation device such as a packer, straddle or valve previously positioned in the wellbore; setting a tubing hanger in the wellbore to set a string of tubing (which may be a wellbore-lining tubing such as a liner, expandable tubing such as expandable sandscreen or slotted liner, an intervention or workover string or other tool string) in the wellbore; operating a downhole lock to position it in the wellbore, and which may optionally carry or be associated with a downhole tool which is to perform a function in the wellbore at a desired location, the lock optionally cooperating with a profile in the wellbore for setting of the lock; and operating any such downhole tool.

The invention also provides an assembly for use in performing an operation in a well following drilling of a wellbore, the assembly comprising a component for performing an operation in the well following drilling of the wellbore, and an apparatus for sensing a force applied to the component. The apparatus comprises: a tubular member which can be provided in a string of tubing that can be located in the wellbore, the tubing arranged to impart the force on the component; and at least one sensor for measuring the strain in the tubing during application of the force on the component, said sensor mounted in a wall of the tubular member. In the illustrated embodiment, the component for performing the operation in the well may be the packer 28 or the liner hanger running tool 34 shown in FIG. 1 and described above, or some further component for performing a desired operation.

The tubular member takes the form of the tubular member 46 which is provided in the string of drill pipe 35, which is arranged to impart weight and/or torque to the packer 28 and/or liner hanger running tool 34. Further, the at least one sensor takes the form of the three or more strain sensors 48 mounted in the wall 54 of the tubular member 46. Operation of the assembly is described in detail above in relation to FIGS. 1 to 3. The assembly may also comprise a device for transmitting data to surface which is operatively associated with the sensor, for transmitting data relating to the strain in the tubing to surface, said strain being indicative of the force applied to the component. The device takes the form of the fluid pressure pulse generating device 50 or acoustic device 150 described in detail above.

Whilst the method and assembly of the invention has been described in relation to a well construction operation involving the application of force to a component in a wellbore, it will be appreciated that certain principles underlying the disclosed method and assembly have a wider utility more generally in the field of the oil and gas exploration and production industry. In particular, the data transmission methods and associated equipment described above may have a utility in the transmission of data relating to parameters other than the force (weight and/or torque) applied to a component in a wellbore.

Thus in an embodiment of the invention, there is provided a method of monitoring a parameter in a wellbore during performance of an operation in the well, the method comprising the steps of: monitoring at least one parameter in a wellbore; performing an operation in the wellbore; monitoring a change in the at least one parameter resulting from performance of the operation; and operating a fluid pressure pulse generating device located in the wellbore to transmit data relating to the resultant change in the at least one parameter to surface; in which the step of operating the pulse generating device comprises arranging the device to operate in an enhanced data transmission mode, in which the device generates fluid pressure pulses which are indicative that the desired level is being approached, a characteristic of the pulses progressively changing as the desired level is approached.

The step of operating the pulse generating device may comprise arranging the device to operate: in a first data transmission mode, in which the device generates trains of fluid pressure pulses, the trains of pulses being representative of the at least one measured parameter; and on reaching a threshold which is a determined amount above or below a desired level for the at least one parameter, operating the pulse generating device in the enhanced data transmission mode, in which the device generates fluid pressure pulses which are indicative that the desired level is being approached, a characteristic of the pulses progressively changing as the desired level is approached. The enhanced data transmission mode may therefore be a second data transmission mode.

The method of this embodiment of the invention has a utility for monitoring a wide range of different parameters in a wellbore, and changes in such parameters resulting from performance of the operation in question. The parameter may be selected from the non-limiting group comprising: 1) a force applied to a component employed to perform an operation; 2) pressure (in the tubing and/or in the annular region between the tubing and the wellbore); 3) temperature; and 4) well geometry parameters.

Possible operations affecting parameters falling within option 1) include the application of a force (e.g. through application of weight and/or torque) to the component. One suitable example is the application of weight and/or torque to set a wellbore isolation device in the wellbore, which may be a straddle, packer or valve. The example of applying force to one such component, in the form of a packer 28, is described in detail above in relation to FIGS. 1 to 3.

Possible operations affecting parameter 2) include actuating a wellbore isolation device to open or close flow to or from part of a wellbore, such resulting in a change in downhole pressure(s).

Possible operations affecting parameter 3) include actuating a wellbore isolation device to open or close flow to or from part of a wellbore, such resulting in a change in downhole temperature(s).

Possible operations affecting parameters falling within option 4) include deviating a drilling or milling tool from the vertical, such affecting wellbore inclination and/or azimuth (position on a compass relative to north).

The skilled person will readily appreciate other possible parameters which might be monitored in the method of this embodiment of the invention, and which may change as a result of performing an operation in a wellbore.

Various modifications may be made to the foregoing without departing from the spirit or scope of the present invention.

Data transmission employing fluid pressure pulse generating devices and acoustic devices is disclosed herein. It will be understood that other data transmission methods may be employed, including but not restricted to wire to surface; inductive couplings in the tubing; and by contact between a component deployed into the well (e.g. on wireline) that communicates with equipment in the wellbore to download the data.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

While compositions and methods are described herein in terms of "comprising" various components or steps, the compositions and methods can also "consist essentially of" or "consist of" the various components and steps.

Embodiments disclosed herein include Embodiment A, Embodiment B, and Embodiment C.

Embodiment A

A method of monitoring a force applied to a component in a well bore following drilling of the well bore and during a subsequent operation in the well, the method comprising the steps of: providing a string of tubing including a tubular member having at least one sensor for measuring the strain in the tubing, and a device for transmitting data to surface and which is operatively associated with the sensor; running the string of tubing into the wellbore; monitoring the strain in the tubing measured by the sensor and compensating for any residual strain; performing an operation in the well employing the tubing, involving the application of a force to the component in the well bore; monitoring the resultant change in strain in the tubing measured by the sensor; and transmitting data relating to the resultant change in strain to surface using the data transmission device, to facilitate determination of the force applied to the component.

Embodiment A may have one or more of the following additional elements in any combination:

Element A1: The method wherein the data transmission device is a device for generating a fluid pressure pulse downhole; the method comprises the further steps of: activating at least one pump associated with the string of tubing, to supply fluid into the wellbore; and waiting a period of time following activation of said pump to allow downhole pressures in the region of the tubular member to stabilize; and in which the step of monitoring the strain in the tubing comprises monitoring the resultant strain in the tubing measured by the sensor and compensating for strain in the tubing resulting from flow induced stress.

Element A2: The method in which the further steps of the method are carried out prior to performance of the operation in the well.

Element A3: The method in which the device employs the flowing fluid to transmit the data to surface, by way of fluid pressure pulses.

Element A4: The method in which the well operation is selected from the group comprising: a) positioning a component at a desired location in the wellbore; b) retrieving a component which has previously been positioned in the wellbore; c) operating a component which has been previously positioned in the wellbore.

Element A5: The method in which the well operation is selected from the group comprising: a) positioning a component at a desired location in the wellbore; b) retrieving a component which has previously been positioned in the wellbore; c) operating a component which has been previously positioned in the wellbore and in which the well operation is d) a combination of two or more of options a) to c).

Element A6: The method in which, subsequent to monitoring the strain in the tubing resulting from flow induced stress, the method comprises the step of transmitting data relating to the strain in the tubing to surface using the pulse generating device and making a determination at surface of the compensation which should be applied based on the received data.

Element A7: The method in which, subsequent to monitoring the strain in the tubing resulting from flow induced stress, the method comprises making a determination of the compensation which should be applied downhole.

Element A8: The method in which the step of providing the string of tubing involves providing at least one pressure sensor in the tubing, and transmitting downhole pressure data to surface using the pulse generating device, which is associated with the pressure sensor.

Element A9: The method in which the step of transmitting the data relating to the resultant change in strain to surface comprises operating the pulse generating device in an enhanced data transmission mode in which the device generates fluid pressure pulses which are indicative that the desired application force is being approached, a characteristic of the pulses changing progressively as force applied increases.

Element A10: The method in which the step of transmitting the data relating to the resultant change in strain to surface comprises: initially operating the pulse generating device in a first data transmission mode, in which the device generates trains of fluid pressure pulses, the trains of pulses being representative of the actual force applied to the downhole component; and on reaching a threshold which is a determined level below the force which is to be applied to the component, operating the pulse generating device in a second data transmission mode, in which the device generates fluid pressure pulses which are indicative that the desired application force is being approached, a characteristic of the pulses changing progressively as force applied increases.

Element A11: The method using a pulse generation device in which the characteristic which changes as the force applied increases is a dwell time between the pulses.

Element A12: The method using a pulse generation device in which the duration of the pulses is substantially constant.

Element A13: The method using a pulse generation device in which a dwell time between the pulses generated in the enhanced/second data transmission mode is employed to transmit data.

Element A14: The method using a pulse generation device in which the dwell time between pulses changes when the force which is to be applied is reached.

Element A15: The method using a pulse generation device in which forces of the same magnitude below and above the desired force have different dwell times.

Element A16: The method using a pulse generation device in which, in the enhanced data transmission mode, the dwell time between the pulses correlates to the amount of the difference between the measured force and the desired level.

Element A17: The method using a pulse generation device in which the dwell time between the pulses generated in the enhanced/second transmission mode reduces in duration as the desired force to be applied is approached.

Element A18: The method using a pulse generation device in which, in the event that the desired force level is reached and continued application of force occurs, the dwell time of the pulses generated starts to increase in duration.

Element A19: The method using a pulse generation device in which the characteristic which changes as the force applied increases is a duration of the pulses.

Element A20: The method using a pulse generation device in which a dwell time between the pulses generated in the enhanced/second data transmission mode is substantially constant.

Element A21: The method using a pulse generation device in which, in the enhanced data transmission mode, the pulse generating device issues a constant stream of pulses indicative of the difference between the threshold force and the force which is to be applied to the component.

Element A22: The method using a pulse generation device in which the step of transmitting the data comprises the further step of setting a second threshold which is a determined level above the force which is to be applied to the component and, on reaching the second threshold, returning the pulse generating device to operate in the first data transmission mode.

Element A23: The method using a pulse generation device in which a dedicated pulse or train of pulses is generated when the desired force has been reached.

Element A24: The method using a pulse generation device in which, in the first data transmission mode, the method comprises issuing trains of pressure pulses at determined intervals of applied force.

Element A24: The method comprising storing the strain data in a memory device provided in the tubing; retrieving the tubing to surface following completion of the operation; downloading the data stored in the device; and performing a more detailed assessment of the force applied to the component.

Element A25: The method in which the data transmission device is arranged to transmit the data to surface acoustically.

Element A26: The method in which the device takes the form of an acoustic data transmission device comprising a primary transmitter associated with the at least one sensor, for transmitting the data.

Embodiment A can include combinations of one or more of any of Elements A1-A26, in any combination.

Embodiment B

An assembly for use in performing an operation in a well following drilling of a wellbore, the assembly comprising: a component for performing an operation in the well following drilling of the wellbore; and an apparatus for sensing a force applied to the component, the apparatus comprising: a tubular member which can be provided in a string of tubing that can be located in the wellbore, the tubing arranged to impart the force on the component; and at least one sensor for measuring the strain in the tubing during application of the force on the component, said sensor mounted in a wall of the tubular member.

Embodiment B may have one or more of the following additional elements in any combination:

Element B1: The assembly comprising a device for transmitting data to surface which is operatively associated with the sensor, for transmitting data relating to the strain in the tubing to surface, said strain being indicative of the force applied to the component.

Element B2: The assembly in which the data transmission device is a device for generating a fluid pressure pulse downhole Element B3: The assembly in which the data transmission device is arranged to transmit the data to surface acoustically.

Embodiment B can include combinations of one or more of any of Elements B1-B3, in any combination

Embodiment C

A method of monitoring a parameter in a wellbore during performance of an operation in the well, the method comprising the steps of: monitoring at least one parameter in a wellbore; performing an operation in the wellbore; monitoring a change in the at least one parameter resulting from performance of the operation; and operating a fluid pressure pulse generating device located in the wellbore to transmit data relating to the resultant change in the at least one parameter to surface; in which the step of operating the pulse generating device comprises arranging the device to operate in an enhanced data transmission mode, in which the device generates fluid pressure pulses which are indicative that the desired level is being approached, a characteristic of the pulses progressively changing as the desired level is approached.

Embodiment C may further include the following element:

Element C1: The method in which the step of operating the pulse generating device comprises arranging the device to operate: in a first data transmission mode, in which the device generates trains of fluid pressure pulses, the trains of pulses being representative of the at least one measured parameter; and on reaching a threshold which is a determined amount above or below a desired level for the at least one parameter, operating the pulse generating device in the enhanced data transmission mode, in which the device generates fluid pressure pulses which are indicative that the desired level is being approached, a characteristic of the pulses progressively changing as the desired level is approached.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method, comprising:

introducing a string of tubing into a wellbore, the string of tubing including a component and a tubular member coupled to the string of tubing;

performing an operation with the string of tubing by applying a force to the component within the wellbore;

measuring a strain assumed by the string of tubing with at least one strain sensor included in the tubular member;

transmitting fluid pressure pulses relating to the strain to a surface location via a fluid in the wellbore using a pressure pulse generating device and thereby determining a force applied to the component, wherein the pressure pulse generating device is positioned within a wall of the tubular member such that a bore through the tubular member remains unrestricted;

operating the pressure pulse generating device in a first data transmission mode until reaching a force threshold below a desired application force to be applied to the component; and operating the pressure pulse generating device in a second data transmission mode upon reaching the force threshold.

2. The method of claim 1, wherein performing the operation with the string of tubing is preceded by:

activating a pump to supply a fluid into the wellbore;

allowing a downhole fluid pressure adjacent the tubular member to stabilize; and measuring a flow induced stress on the string of tubing with the at least one strain sensor, and wherein measuring the strain assumed by the string of tubing includes compensating for the flow induced stress.

3. The method of claim 2, wherein at least one pressure sensor is positioned in the tubular member, the method further comprising monitoring the downhole fluid pressure with the at least one pressure sensor and transmitting downhole pressure data to the surface location using the pressure pulse generating device.

4. The method of claim 1, wherein operating the pressure pulse generating device in the first data transmission mode comprises generating one or more trains of fluid pressure pulses where a duration of the fluid pressure pulses is constant.

5. The method of claim 1, wherein operating the pressure pulse generating device in the second data transmission mode comprises progressively changing a dwell time of fluid pressure pulses until reaching the desired application force.

6. The method of claim 5, further comprising progressively changing the dwell time of fluid pressure pulses after surpassing the desired application force.

7. The method of claim 5, wherein the dwell time between the fluid pressure pulses correlates to a difference between a measured strain and the desired application force.

8. The method of claim 1, further comprising operating the pressure pulse generating device to generate a dedicated train of fluid pressure pulses upon reaching the desired application force.

9. The method of claim 1, further comprising:

storing the fluid pressure pulses relating to the strain in a memory device provided in the tubular member;

retrieving the tubular member to the surface location following completion of the operation;

downloading the fluid pressure pulses stored in the memory device; and assessing the force applied to the component.

10. The method of claim 1, wherein applying the force to the component within the wellbore comprises applying an axial force to the string of tubing.

11. The method of claim 1, wherein applying the force to the component within the wellbore comprises applying a torsional force to the string of tubing.

12. An assembly, comprising:

a string of tubing including a component for performing an operation in a wellbore upon assuming a force applied by the string of tubing;

a tubular member coupled to the string of tubing and including at least one strain sensor for measuring strain assumed by the string of tubing; and a pressure pulse generating device positioned within a wall of the tubular member such that a bore through the tubular member remains unrestricted, the pressure pulse generating device being configured to transmit fluid pressure pulses relating to the strain to a surface location and thereby determine a force applied to the component, operate in a first data transmission mode until reaching a force threshold below a desired application force to be applied to the component, and operate in a second data transmission mode upon reaching the force threshold.

* * * * *